US008349098B2

(12) United States Patent
Macherey et al.

(10) Patent No.: US 8,349,098 B2
(45) Date of Patent: Jan. 8, 2013

(54) PROCESS FOR PRODUCING A COMPONENT FROM A STEEL PRODUCT PROVIDED WITH AN AL-SI COATING AND INTERMEDIATE PRODUCT OF SUCH A PROCESS

(75) Inventors: Friedhelm Macherey, Alpen (DE); Franz-Josef Lenze, Lennestadt (DE); Michael Peters, Kleve (DE); Manuela Ruthenberg, Dortmund (DE); Sascha Sikora, Lünen (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 239 days.

(21) Appl. No.: 12/865,143

(22) PCT Filed: Jan. 29, 2009

(86) PCT No.: PCT/EP2009/050980

§ 371 (c)(1),
(2), (4) Date: Nov. 22, 2010

(87) PCT Pub. No.: WO2009/095427

PCT Pub. Date: Aug. 6, 2009

(65) Prior Publication Data

US 2011/0056594 A1 Mar. 10, 2011

(30) Foreign Application Priority Data

Jan. 30, 2008 (DE) ..... 10 2008 006 771

(51) Int. Cl.
*C21D 8/02* (2006.01)
*C23C 2/12* (2006.01)

(52) U.S. Cl. ..... 148/530; 148/531; 428/653; 428/939

(58) Field of Classification Search ..... 148/530, 148/531; 428/653, 939
See application file for complete search history.

(56) References Cited

U.S. PATENT DOCUMENTS

| | | | |
|---|---|---|---|
| 4,150,178 | A | 4/1979 | Yagi et al. |
| 2002/0018909 | A1 | 2/2002 | Mareuse et al. |
| 2007/0163683 | A1 | 7/2007 | Schiessl |

FOREIGN PATENT DOCUMENTS

| | | | |
|---|---|---|---|
| DE | 102004007071 | B4 | 1/2006 |
| EP | 1380666 | A1 | 1/2004 |
| JP | 5585623 | A | 6/1980 |

OTHER PUBLICATIONS

DIN EN 10292, "Continuously hot-dip coated strip and sheet of steels with high yield strength for cold forming", Jun. 2007, pp. 1-25.
DIN EN 10327, "Continuously hot-dip coated strip and sheet of low carbon steels for cold forming", Sep. 2004, pp. 1-24.

*Primary Examiner* — Emily Le
*Assistant Examiner* — Rebecca Lee
(74) *Attorney, Agent, or Firm* — The Webb Law Firm

(57) ABSTRACT

A process for producing a component from a steel product coated with a protective Al—Si coating, and an intermediate product that arises during the course of such a process and that can be used to produce components of the type concerned here. The steel product coated with the Al—Si coating, undergoes a first heating stage in which the temperature and the duration of the heat treatment are set such that the Al—Si coating is only partially pre-alloyed with Fe from the steel product. Then, the steel product, in a second heating stage, is heated to a heating temperature, above the Ac1 temperature, at which the steel product has an at least partially austenitic structure, wherein the temperature and the duration of the second heating stage are set such that the Al—Si coating is fully alloyed with Fe from the steel product. After the steel product is heated to the heating temperature, it is shaped to form the component and the component obtained is cooled in a controlled manner, in order to obtain a martensitic structure.

27 Claims, 1 Drawing Sheet

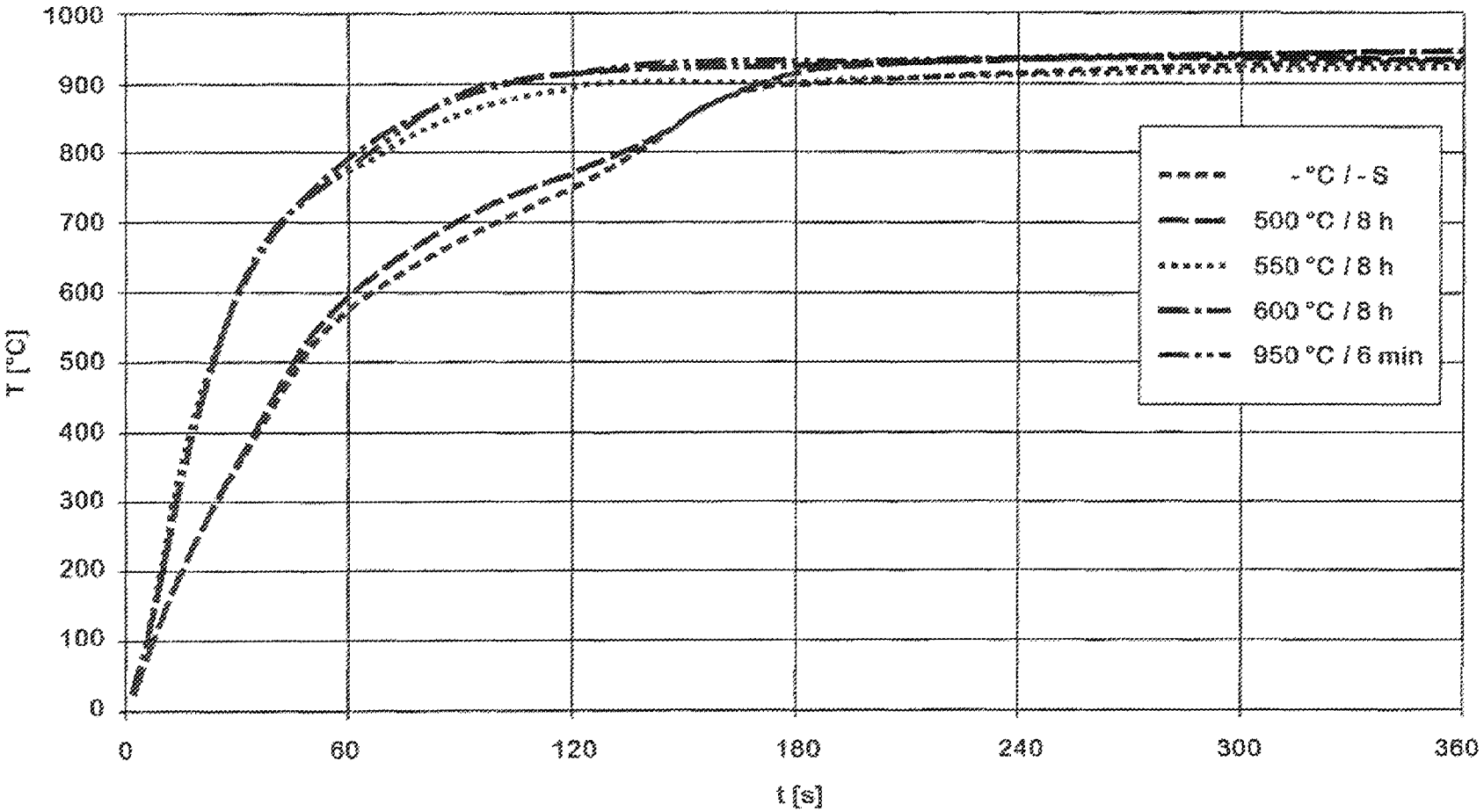
°C / - S
500 °C / 8 h
550 °C / 8 h
600 °C / 8 h
950 °C / 6 min
T [°C]
t [s]
0
100
200
300
400
500
600
700
800
900
1000
0
60
120
180
240
300
360

PROCESS FOR PRODUCING A COMPONENT FROM A STEEL PRODUCT PROVIDED WITH AN AL-SI COATING AND INTERMEDIATE PRODUCT OF SUCH A PROCESS

BACKGROUND OF THE INVENTION

1. Field of the Invention

The invention relates to a process for producing a component from a steel product coated with a protective Al—Si coating. The invention moreover relates to an intermediate product that arises during the course of such a process and that can be used to produce components of the type concerned here.

2. Description of the Related Art

Steel products of the type concerned here would typically be steel strips or sheets that are provided with an Al—Si coating in a known way, for example by hot-dip aluminising. The products concerned can, however, also be pre-formed, semi-finished products, which, for example, are pre-formed from sheet metal and then formed into the given finished product.

The Al—Si coating protects the component, formed from the given steel product, against corrosion during its period of use. The Al—Si coating nevertheless also provides an anti-corrosion effect, particularly protection against scaling, immediately following the coating of the steel substrate and maintains it during the deformation procedure. This particularly applies where the shaping occurs by means of what is known as "press hardening".

In press hardening, the raw product to be shaped is brought, before shaping, to a temperature at which there is an at least partially austenitic structure and is then shaped while hot. The component obtained is then cooled in an accelerated manner either during the hot shaping procedure or immediately after it, in order to form a martensitic structure. Flat products, such as sheet-metal blanks or semi-finished products that have already been pre-formed or that are shaped at the end of the procedure, are used as raw product for the press hardening.

During the press hardening, the Al—Si coating prevents scales, which would considerably impede the shaping procedure, from forming on the steel product. In this way, it is possible to shape high-strength, heat-treatable steels that are exposed to particularly high levels of loading in the field.

A steel product typically used for this purpose is known in the field as "22MnB5". Car body parts, which have to show a high level of strength even though they have a thin flat product thickness and are consequently comparably low in weight, are for example produced from steel products of this kind. Equally, other steel products, such as deep drawn steels of the type known under the trade name "DX55D" and composed in accordance with German industrial standard DIN EN 10327, and micro-alloy steels of the type alloyed in accordance with German industrial standard DIN EN 10292 and obtainable in the trade under the designation "HX300/340 LAD", can nevertheless also be press mould hardened. It is also possible to use the raw products which according to the type of tailored blanks/patchwork blanks are made up of a plurality of sheets.

So that the Al—Si coating adheres so solidly for it not to break or peel during shaping, it is necessary for the steel product provided with the Al—Si coating to undergo heat treatment in which iron from the steel substrate is alloyed into the Al—Si coating. The aim here is to alloy the coating throughout its entire thickness to ensure that there are also no breaks or peeling off on the upper layers of the coating that abut against the free, outer side of the coated flat product. The type or level of full-layer alloying of Al—Si coatings moreover has an effect on the ease with which the components produced by press hardening can be welded and lacquered.

A process of the type described above is described in EP 1 380 666 A1. In this process, a steel sheet with an Al—Si coating is first heated to a temperature of 900° C. to 950° C., for 2 to 8 minutes. The coated steel sheet is then cooled to a temperature of 700-800° C. and is hot-shaped at this temperature. The shaped steel part is then quickly cooled to a temperature below 300° C. in order to produce a martensitic texture in the steel part obtained. The heat treatment of the steel substrate provided with the coating is carried out such that through diffusion of the iron from the steel substrate after the heat treatment the iron content in the coating lies between 80 and 95%. In this way, a hot-shaped component is to be obtained, combining good capacity for being welded, a good level of formability and a high level of corrosion protection.

One problem in carrying out the heat treatment that is necessary to obtain full-layer alloying is that, alongside setting a sufficient heating temperature, the product must also be left in the furnace for a certain time-period. The time-period for which the given steel product must be kept in the furnace is a function of the speed at which the substrate is heated, and of the necessary full-layer alloying of the substrate with the Al—Si layer. In the state of the art, the time in the furnace is from five to 14 minutes.

In practice, radiation furnaces are used for the heating, carried out before the hot-shaping, of the steel products provided with Al—Si coatings. Fundamental research on the behaviour under heating of steel products provided with Al—Si coatings in this context has shown that, in such furnaces, the reflection of the heat radiation from the surface of the given coating leads to a reduced heating speed by comparison with uncoated, or organically or inorganically coated, materials. Accordingly, a relatively long time-period has to be taken into account for the heating.

This long time-period leads to long processing times at the plant processing the flat products provided with an Al—Si coating, which increases not only the cycle times in producing the given component but also the equipment complexity of the furnace needed for the heating.

It would technically also be possible to heat the steel basis material of the flat products with its coating more quickly through inductive or conductive heating. The heating could also be accelerated by forced convection of the heat radiation. In the case of accelerated heating, there is nevertheless the risk that the alloying process in the Al—Si coating layer runs more slowly than the heating, with the result that the Al—Si layer is not fully alloyed or there are defects in the alloying. In an extreme case, the Al—Si layer may even run off the steel product.

An attempt is known, from DE 10 2004 007 071 B4, to reduce the processing time at the plant processing the flat products provided with an Al—Si coating by carrying out the full-layer alloying of the coating and the heating of the flat steel product to the relevant temperature in two separate stages. This approach enables the full-layer alloying process to be carried out with the manufacturer of the flat steel product provided with the Al—Si coating. The heating of the flat steel product provided with the coating which has already been full-layer alloyed can then take place at the plant, for example by means of induction or conduction, in an optimally short time-period and without needing to consider the formation of the coating. Accordingly, when using the known process, it is inherently possible to store flat steel products that have already been provided by the manufacturer with a full-layer alloyed coating in an intermediate storage facility, from which they can then be retrieved at short notice for further processing at the plant.

However, the proposal set out above is problematic in that the full-layer alloyed coating is itself subject to corrosion both during storage of the pre-produced flat steel products in the intermediate storage facility and also during the course of the working stages carried out at the plant. The problem arises from the iron content that is present on the exposed surface of the full-layer alloyed coating. In order to overcome such surface corrosion, costly protective measures are required that largely eat up the advantages gained in separating the full-layer alloying and press hardening. Added to this is the fact that cutting the flat product blanks coated with the full-layer alloyed coating, which cutting becomes necessary under certain circumstances before the hot-shaping, is difficult because full-layer alloyed Al—Si layers are hard and brittle. In view of the state of the art as outlined above, the object forming the basis of the invention was to create a process enabling shorter processing times at the plant for steel products provided with an Al—Si coating, without a risk of corrosion or disadvantages for subsequent cutting of the coated flat products having to be taken into account.

SUMMARY OF THE INVENTION

The steel product processed according to the invention can be a flat steel product, such as a steel sheet or strip, or a semi-finished product that has been pre-formed for example from a steel sheet, the shaping of which is finished in the hot press hardening carried out according to the invention. A plurality of sheets composed in the manner of tailored blanks/patchwork blanks can also be processed according to the invention.

There is also two-stage heat treatment in the process according to the invention, wherein in the first heating stage, likewise according to the state of the art, iron from the steel substrate is alloyed into the Al—Si layer.

In contrast to the state of the art, however, this first alloying stage is carried out by setting a suitable temperature and treatment duration, such that the Al—Si coating is only incompletely alloyed with iron from the steel product after the first heating stage.

The steel product provided with the incompletely alloyed coating according to the invention can then be cooled to room temperature and stored until it is supplied to the given component for further processing. Since the Al—Si coating is only incompletely alloyed in the first heating stage, the Al—Si coating is still slightly susceptible to corrosion after the first heating stage, such that storage and carriage of it and the further work stages carried out before the second heat treatment can be carried out without further measures being necessary.

At the same time, the coating that, according to the invention, is only partially alloyed during the course of the first heating stage, keeps a toughness that, even after the first heating stage, enables the flat products obtained to be divided or cut in simple cutting operations without lasting damage to the coating layer.

Before being shaped into the component, the flat product obtained after the first heating stage and provided according to the invention with a coating that is only pre-alloyed undergoes a second heating stage. This second heating stage is generally carried out at the final processing plant, while the first heat treatment stage to be completed generally occurs with the producer of the steel products.

The second heating stage is normally completed immediately before the hot-shaping. In the course of the second heating stage, the steel product provided according to the invention only with a pre-alloyed Al—Si coating is heated to the heating temperature required for the subsequent hardening, which lies above the Ac1 temperature, at which the steel product has an at least partially austenitic structure. Where necessary, a heating temperature corresponding to at least the Ac3 temperature or above it can be set in order to give the raw product being formed a structure that is as fully austenitic as is possible.

With this, the temperature and duration of the second heating stage are to be set according to the invention such that the Al—Si coating is fully alloyed with the Fe from the steel product during the course of the second heating stage.

Surprisingly, it has been found in this context that the coating that in accordance with the invention has only partially been alloyed with the steel substrate, by comparison with the heating of flat products provided with fully alloyed Al—Si—Fe coatings, has a reflectivity that enables a markedly higher speed of heating to the required temperature when heated in radiation furnaces, without the coating running off.

An intermediate product obtained in a manner according to the invention is thereby characterised in that it is provided with an Al—Si coating that is only incompletely pre-alloyed with the iron from the steel substrate.

Following the second heating stage, the raw product that is now provided with a fully alloyed Si—Al—Fe coating is then shaped in a known way in a suitable hot-shaping tool into the desired component. The component obtained may be a fully formed component or may be a semi-finished component, which then undergoes further shaping stages.

Already during the hot-shaping or immediately thereafter, the hot-shaped component is finally cooled in a controlled manner in order to produce a martensitic structure in the steel substrate. The work stages "hot-shaping" and "cooling" can be carried out in particular in the way known from "Press mould hardening".

The procedure according to the invention therefore enables a component that is aluminised and produced by press mould hardening, to be made available economically and at the same time particularly efficiently within shorter processing times. Here, the effort for the heating stage carried out generally by the producers of the steel product is not only reduced because the processing time and the treatment temperature for the only partial alloying of the Al—Si layer with the iron from the steel substrate is shortened in relation to the state of the art, but also the second heating stage, which is generally carried out at the plant processing the only incompletely alloyed Al—Si coating according to the invention, can occur with a shortened process duration, with correspondingly reduced energy requirements and minimised equipment costs.

The fact that after the first heating stage carried out according to the invention there is a lower Fe content in the Al—Si layer than in the component obtained after the hot press hardening, in which there is only a minimal risk of corrosion, makes it possible in particular to cool the steel product to room temperature between the first and the second heating stage and store it, before it is then supplied for further processing. The corrosion prevention effect of the only partially alloyed Al—Si layer present after the first heating stage is so great that the steel product can be transported between the first and the second heating stage into air in a problem-free manner for example between the steel product producer's works and the final processing plant.

BRIEF DESCRIPTION OF THE DRAWINGS

FIG. 1 is a plot showing annealing time t plotted against annealing temperature T for the second heating stage.

DESCRIPTION OF THE PREFERRED EMBODIMENTS

Practical tests have shown that the temperature of the first heating stage is at least 500° C., but at the same time it is at most the same as the $A_{C1}$ temperature of the steel product. In practice, therefore, temperatures lying in the range of 550-723° C., in particular 550-700° C., are particularly suitable for the first heating stage. The mechanically technological parameters of the steel product do not deteriorate through heating to temperatures within this range, and the fundamental structure is preserved in its constituents.

With these heating temperatures, the time-period to be scheduled for the first heating stage for Al—Si coating thicknesses in the initial state of 10-30 μm (corresponding to 80-150 g/m$^2$) should, where the heating occurs in a bell-type annealing furnace, be 4-24 hours. Heating in a continuous furnace or chamber furnace is also conceivable, with the heating times in each case being less than one hour.

The temperature and duration of the first treatment stage are preferably set such that the Al—Si coating, measured starting from the steel substrate, is alloyed over at least 50%, in particular 70-99%, preferably 90-99%, of its thickness with Fe.

Depending on the furnace technology used by the manufacturer of the steel product, the first heating stage can be carried out in a bell-type annealing furnace, chamber furnace or continuous annealing furnace. In the case of processing a flat steel product, it is possible to obtain pre-alloying in a continuous furnace which is arranged directly in line with the outlet from a coating unit, in a similar way to a galvannealing unit, and the heating occurs within a range of between 600 and 723° C. Equally, the steel product provided with an only partially alloyed Al—Si coating and obtained in accordance with the invention can be heated in a second heating stage to the necessary heating temperature in a continuous furnace. The second heating can here be inductive, conductive, or can occur by heat radiation.

The invention is explained in more detail below by reference to an exemplary embodiment.

Samples were examined of a steel sheet that was 1.5 mm thick and that, alongside iron and unavoidable impurities, contained (in % weight) C: 0.226%, Si: 0.25%, Mn: 1.2%, Cr: 0.137%, Mo: 0.002%, Ti: 0.034%, B: 0.003%, and that had been provided with a 20 μm-thick (corresponding to 120 g/m$^2$) Al—Si coating by means of conventional hot-dip aluminising.

The samples were placed in a trial furnace modelled on a bell-type annealing furnace each for eight hours of heat treatment corresponding to a first heating stage of the process according to the invention. A first set of samples was annealed here at 500° C., a second set at 550° C., and a third set at 600° C. Further samples were additionally passed through a continuous furnace for six minutes at a temperature of 950° C. This represents typical press hardening heat treatment, in which the Al—Si coating layer is alloyed. After the given annealing, the samples were cooled to room temperature. The samples obtained, up to the sample heat-treated at 950° C., had an incompletely alloyed Al—Si coating layer.

Then the previously annealed and cooled samples were in an annealing treatment corresponding to the second heating stage heated to a heating temperature of 950° C. in a radiation furnace, giving the steel substrate an austenitic structure. Heating rates were measured in the process, i.e. it was observed how quickly the samples were heated to the target temperature of 950° C.

FIG. 1 shows the annealing time t plotted against the temperature T of the given samples. The temperature profile for a sample that was not annealed in a previous first heating stage is also entered into FIG. 1 (curve "–° C./–s").

It can be seen that, for the samples examined, heating rates are optimal when the samples have been annealed for 8 hours at a temperature of 550° C. or 600° C. in a bell-type annealing furnace in the first heating stage. Equally good heating behaviour was also observed for the samples annealed in the continuous furnace for six minutes at 950° C.

The reason for the poorer heating behaviour for the samples previously annealed at 500° C. for 8 hours is that, in these samples, the reflection of the radiation in the upper unalloyed layer of the Al—Si coating behaves exactly as in conventional Al—Si coatings in the as-supplied state without prior heat treatment.

The process according to the invention makes it possible to markedly shorten the times needed to carry out full alloying in a hardening furnace before the hot-shaping. Thus it has been possible to show that a gain of at least 90 seconds can be expected in relation to the conventional procedure. With such a gain in time, the furnaces needed for heating before hot-shaping can be designed smaller. Maintaining furnaces of a conventional size requires cooling to room temperature over approximately 10 days, while the reduction in furnace size allowed for by the invention allows a gain of at least 2 to 3 days needed for cooling.

The invention claimed is:

1. A process for producing a component from a steel product coated with a protective Al—Si coating comprising:

heating the steel product coated with the Al—Si coating in a first heating stage wherein temperature and duration of the first heating stage are set such that the Al—Si coating is only partially pre-alloyed with Fe from the steel product;

cooling the steel product having the partially pre-alloyed Al—Si coating;

heating the cooled steel product having the partially pre-alloyed Al—Si coating, in a second heating stage, to a heating temperature, above the Ac1 temperature, at which the steel product has an at least partially austenitic structure, wherein temperature and duration of the second heating stage are set such that the Al—Si coating is fully alloyed with Fe from the steel product during the course of the second heating stage;

shaping the steel product heated to the heating temperature to form the component; and cooling the component obtained in a controlled manner, in order to obtain a martensitic structure.

2. The process according to claim 1, wherein the steel product is cooled to room temperature, between the first and the second heating stage.

3. The process according to claim 2, wherein the steel product is transported into air between the first and the second heating stage.

4. The process according to claim 1, wherein the temperature of the first heating stage is at least 500° C. and, at the same time, is at most the same as the Ac1 temperature of the steel product.

5. The process according to claim 1, wherein the temperature of the first heating stage is 550-723° C.

6. The process according to claim 1, wherein the first heating stage is carried out in a bell annealing furnace.

7. The process according to claim 1, wherein the first heating stage is carried out in a continuous furnace.

8. The process according to claim 1, wherein the heating temperature to which the steel product is heated in the second heating stage corresponds to at least the Ac3 temperature.

9. The process according to claim 1, wherein the second heating stage is carried out in a continuous furnace.

10. The process according to claim 1, wherein the second heating stage is carried out in a chamber furnace.

11. The process according to claim 1, wherein the steel product consists of quenched and tempered steel.

12. The process according to claim 1, wherein the steel product is a flat steel product.

13. The process according to claim 1, wherein the steel product is a pre-formed, semi-finished product.

14. A process for producing a component from a steel product having a partially pre-alloyed Al—Si coating formed by heating a steel product coated with a protective Al—Si coating in a first heating stage and cooling the steel product, the process comprising:

obtaining the cooled steel product having the partially pre-alloyed Al—Si coating;

heating the obtained steel product having the partially pre-alloyed Al—Si coating, in a second heating stage, to a heating temperature, above the Ac1 temperature, at which the steel product has an at least partially austenitic structure, wherein temperature and duration of the second heating stage are set such that the Al—Si coating is fully alloyed with Fe from the steel product during the course of the second heating stage;

shaping the steel product heated to the heating temperature to form the component; and cooling the component obtained in a controlled manner, in order to obtain a martensitic structure.

15. The process according to claim 14, wherein the heating temperature to which the intermediate steel product is heated in the second heating stage corresponds to at least the Ac3 temperature.

16. The process according to claim 14, wherein the second heating stage is carried out in a continuous furnace.

17. The process according to claim 14, wherein the second heating stage is carried out in a chamber furnace.

18. The process according to claim 14, wherein the steel product consists of quenched and tempered steel.

19. The process according to claim 14, wherein the steel product is a flat steel product.

20. The process according to claim 14, wherein the steel product is a pre-formed, semi-finished product.

21. A process for producing a steel product having a partially pre-alloyed Al—Si coating useful for producing a component from said steel product by heating the steel product having the partially pre-alloyed Al—Si coating, in a second heating stage, to a heating temperature, above the Ac1 temperature, at which the steel product has an at least partially austenitic structure, during which the Al—Si coating is fully alloyed with Fe from the steel product, shaping the steel product heated to the heating temperature to form the component, and cooling the component obtained in a controlled manner, in order to obtain a martensitic structure, the process comprising:

heating a steel product coated with the Al—Si coating in a first heating stage wherein temperature and duration of the first heating stage are set such that the Al—Si coating is only partially pre-alloyed with Fe from the steel product; and cooling and storing the steel product having the partially pre-alloyed Al—Si coating.

22. The process according to claim 21, wherein the steel product having the partially pre-alloyed Al—Si coating is cooled to room temperature.

23. The process according to claim 21, wherein the steel product having the partially pre-alloyed Al—Si coating is transported into air.

24. The process according to claim 21, wherein the temperature of the first heating stage is at least 500° C. and, at the same time, is at most the same as the Ac1 temperature of the steel product.

25. The process according to claim 21, wherein the temperature of the first heating stage is 550-723° C.

26. The process according to claim 21, wherein the first heating stage is carried out in a bell annealing furnace.

27. The process according to claim 21, wherein the first heating stage is carried out in a continuous furnace.

* * * * *